United States Patent [19]

Conforti et al.

[11] 4,020,479

[45] Apr. 26, 1977

[54] FIRE DETECTOR

[75] Inventors: Frederick J. Conforti; Wilbur L. Ogden, both of Aurora, Ill.

[73] Assignee: Pittway Corporation, Northbrook, Ill.

[22] Filed: Feb. 7, 1975

[21] Appl. No.: 548,003

Related U.S. Application Data

[63] Continuation-in-part of Ser. No. 431,137, Jan. 7, 1974, abandoned.

[52] U.S. Cl. ..... 340/237 S; 340/249; 250/389; 324/29.5

[51] Int. Cl.[2] ..... G08B 21/00

[58] Field of Search ..... 340/237 S, 249, 228 R; 324/29.5; 250/389

[56] References Cited

UNITED STATES PATENTS

| | | | |
|---|---|---|---|
| 3,594,751 | 7/1971 | Ogden | 340/249 X |
| 3,786,342 | 1/1974 | Molyneux | 340/249 X |
| 3,886,195 | 2/1975 | Ried | 340/237 S |
| 3,899,732 | 8/1975 | Staby | 340/249 X |

*Primary Examiner*—John W. Caldwell
*Assistant Examiner*—William M. Wannisky
*Attorney, Agent, or Firm*—Gary, Juettner & Pyle

[57] ABSTRACT

An improved early warning fire detector of the ionization type is provided wherein detection circuitry having adjustable sensitivity is connected to an ionization chamber responsive to products of combustion. A supervisory circuit monitors the unit to assure that power is applied to the unit, that the detecting circuitry is operative and that the unit is operating at the proper sensitivity.

24 Claims, 2 Drawing Figures

FIRE DETECTOR

CROSS REFERENCE TO RELATED CASE

This application is a continuation-in-part application of U.S. Pat. application Ser. No. 431,137, filed Jan. 7, 1974 and now abandoned.

BACKGROUND OF THE INVENTION

1. Field of the Invention

This invention relates generally to fire detectors of the ionization type that employ an ionization chamber for detecting products of combustion, and more particularly to supervisory circuits for such detectors which assure that the detectors are operating properly.

2. Prior Art

In order to provide maximum fire protection, it is desirable to monitor the operation of the fire protection device to assure that the device is receiving power and that the unit is otherwise operating properly.

Several systems for monitoring the power supplied to a fire protection device are known. These systems generally monitor the voltage of the power supply of the unit and compare the voltage thereof with a reference voltage obtained from, for example, a separate reference battery or reference voltage source, such as a zener diode.

Whereas these techniques provide a way to monitor the power supplied to a fire protection unit, in systems using a reference battery, such as described in U.S. Pat. No. 3,594,751, failure of the reference battery would render the monitoring circuit inoperative. In systems using a zener diode reference, a complete sudden failure of the main power supply would not be detected. Furthermore, the prior art circuits only detect malfunctions in the power supply, not in the detector circuitry itself.

SUMMARY OF THE INVENTION

It is an object of the present invention to provide an improved monitoring system for a fire detection device.

It is a further object of this invention to provide a monitoring circuit for a fire detecting device that assures that power is applied to the unit and that the unit is otherwise operating properly.

It is another object of the invention to provide a variable sensitivity fire detection device of the ionization type that includes a monitoring system that assures that the detecting device is operative at the proper sensitivity.

In accordance with a preferred embodiment of the invention, a MOS-FET transistor amplifier is employed to sense the impedance variations of the ionization chamber which occur in the presence of products of combustion and to provide a voltage representative of the impedance of the chamber. A differential amplifier having a variable voltage applied to one input thereof is connected to the MOS-FET transistor amplifier and triggers an audible alarm when the output voltage from the MOS-FET amplifier drops below the reference voltage applied to the differential amplifier.

A transistorized monitoring circuit is connected to the MOS-FET transistor and to the emitter impedance of the differential amplifier and energizes an indicator light when the bias on the differential amplifier is proper. If the bias is incorrect, indicative of a malfunction in the power supply, detector circuit or an incorrect sensitivity setting, the indicator light is extinquished.

DETAILED DESCRIPTION

Figure 1:
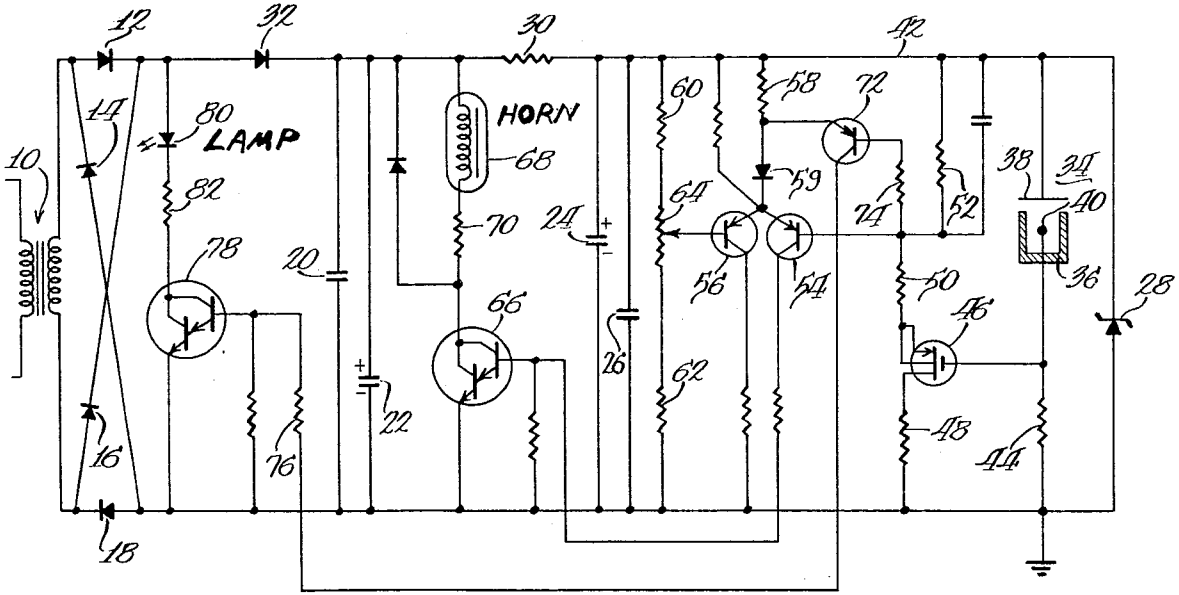
FIG. 1 is a detailed schematic diagram of one embodiment of fire detector of the ionization type employing variable sensitivity and monitoring circuitry according to the invention.

Referring to FIG. 1, a transformer 10 is connected to a 120 volt power line source and to four rectifier diodes 12, 14, 16 and 18 to provide a nominal 12 volts DC to operate the fire detector circuitry. In an alternate embodiment, a battery may be used in place of the transformer 10 and the four diodes to provide a self-contained battery operated unit. Four capacitors 20, 22, 24 and 26 are used to filter the rectifier output voltage from the diodes 12, 14, 16 and 18 and to remove voltage transients resulting from transients on the power line. The voltage applied to the sensing circuitry is regulated to a predetermined fixed voltage, such as, for example, 8.2 volts in this embodiment, by the zener diode 28, which is connected to the rectifier diodes through a resistor 30 and a diode 32.

The fire detection circuitry comprises an ionization chamber 34 having a cup-shaped member 36, a target 38 and a radioactive source of ions 40. The source 40 emits alpha particles which ionize the ambient air passing between the cup-shaped member 36 and the target 38 to provide current flow between the cup-shaped member 36 and the target 38. Products of combustion in the ambient air being of greater mass than ambient air molecules, cause a reduction (pursuant to the formula force equals mass times acceleration) in the amount of ion current flowing between the cup member 36 and the target 38. Consequently, the impedance of the ionization chamber is increased upon the presence in the air of products of combustion. A more detailed explanation of the operation of the ion chamber is given in U.S. Pat. No. 3,594,751 and our copending application Ser. No. 425,307, filed Dec. 17, 1973, assigned to the same assignee.

The target 38 of the ionization chamber 34 is connected to the positive 8.2 volt bus line 42, and the cup-shaped member 36 is connected to ground or common potential through a resistor 44. The junction of the resistor 44 and cup-shaped member 36 is connected to the gate of a MOS-FET transistor 46 to form the sensing means of the detector. The drain of the transistor 46 is connected to ground potential through a resistor 48, and the source thereof is connected to the 8.2 volt bus line 42 through resistors 50 and 52. The junction of the resistors 50 and 52 is connected to the base of a transistor 54, the transistor 54 together with transistor 56 and associated components forming a differential amplifier or first comparison means for comparing signal voltages. The emitters of the transistors 54 and 56 are connected together and coupled to the line 42 through a resistor 58 and a diode 59, the function of which will be explained in a subsequent portion of the specification. The base of the transistor 56 is connected to adjustable reference means or the resistive divider network comprising resistors 60 and 62, and potentiometer 64. The collector of the transistor 54 is connected to the base of a transistor 66, which, in this embodiment, is a Darlington connected transistor pair. The emitter of the transistor 66 is connected to ground, and the collector thereof is connected to a first transducer or alarm means, such as a horn 68, through a resistor 70, to comprise a switch for the horn.

A transistor 72, which comprises the monitoring circuit and second comparison means for comparing signal voltages, has an emitter connected to the junction of the resistor 58 and voltage signal offsettig means or diode 59, and a base connected to the junction of resistors 52 and 50 through a resistor 74. The collector of the transistor 72 is connected through a resistor 76 to the base of a transistor 78, which is also a Darlington connected pair. The emitter of the transistor 78 is connected to a ground potential, and the collector thereof is connected to a second transducer or indicator means, such as a light emitting diode 80, through a current limiting resistor 82, to serve as a switch for the light.

In operation, when no products of combustion are present in the ambient air, the potentiometer 64 is adjusted such that the transistor 56 is rendered conductive. The adjustment is made such that the voltage at the base of the transistor 56 is approximately 0.3 volts lower than the voltage at the base of the transistor 54. When transistor 56 is rendered conductive, the transistor 54 is rendered nonconductive, thereby rendering transistor 66 nonconductive to open the circuit to the horn 68.

In the event of a fire, the products of combustion passing between the target 38 and the cup-shaped member 36 will increase the impedance of the ionization chamber 34, thereby lowering the voltage applied to the gate of the transistor 46. The aforementioned drop in voltage causes the conductivity of the transistor 46 to increase, thereby lowering the voltage at the junction of the resistors 50 and 52. When the voltage at the junction of the resistors 50 and 52, which is applied to the base of the transistor 54, drops below the reference voltage present at the base of the transistor 56, the transistor 56 will be rendered nonconductive and the transistor 54 will be rendered conductive. Rendering transistor 54 conductive causes the base to emitter junction of the transistor 66 to be forward biased, thereby saturating the transistor 66 and completing the circuit to energize the first transduced or horn 68. The unit may be readily made more or less sensitive to changes in the impedance of the ionization chamber 34 by adjusting the potentiometer 64 to provide an offset other than 0.3 volts between the bases of the transistors 54 and 56, a smaller offset rendering the unit more snesitive.

When the potentiometer 64 is correctly set, the voltage across the base to emitter junction of the transistor 54 is approximately 0.3 volts which is insufficient to foward bias the base to emitter junction and to render the transistor conductive. The current flowing through the diode 59 as a result of the conductivity of the transistor 56 causes approximately 0.6 volts to be present across the diode 59. The 0.6 volts present across the diode 59 plus the 0.3 volts across the base to emitter junction of transistor 54 results in a total of 0.9 volts between the anode of the diode 59 and the base of the transistor 54, which is sufficient to turn on the transistor 72. The diode 59 is necessary to provide the additional voltage to turn on the transistor 72, the 0.3 volts across the base to emitter junction of the transistor 54 being insufficient to accomplish this. The aforementioned offset voltages provide satisfactory operation for the circuit shown when silicon transistors are used. However, it should be appreciated that an appropriate change in the offset voltage would be made by one skilled in the art if different transistor types or different circuit configuration were employed.

When the transistor 72 is rendered conductive, current is supplied thereby to the base of the transistor 78 to turn on the second transducer or light source 80 to indicate that the circuit is operating properly.

Should the voltage at the line 42 fail for any reason, the transistor 72 would be rendered nonconductive, thereby rendering transistor 78 nonconductive and extinquishing the light source 80. In similar fashion, should the transistor 46 fail, the most common mode of failure being an open circuit, the voltage at the junction of resistors 50 and 52 would increase, thereby rendering transistor 72 nonconductive and extinguishing the light source 80.

Should the potentiometer 64 be improperly adjusted to provide too high a voltage to the base of the transistor 56, the transistor 56 would be rendered nonconductive and the transistor 54 would be rendered conductive to sound the horn 68. If the potentiometer 64 is improperly adjusted with the voltage at the base of the transistor 56 being too low, the horn would not sound, but the voltage between the anode of the diode 59 and the base of the transistor 54 would be less than 0.9 volts, and the transistor 72 would be rendered nonconductive, thereby extinquishing the light source 80 to indicate improper setting of the potentiometer 64. Hence, the monitoring circuit according to the invention provides the added feature of preventing incorrect setting of the sensitivity adjustment of the unit which could otherwise result in degraded sensitivity of the unit.

Figure 2:
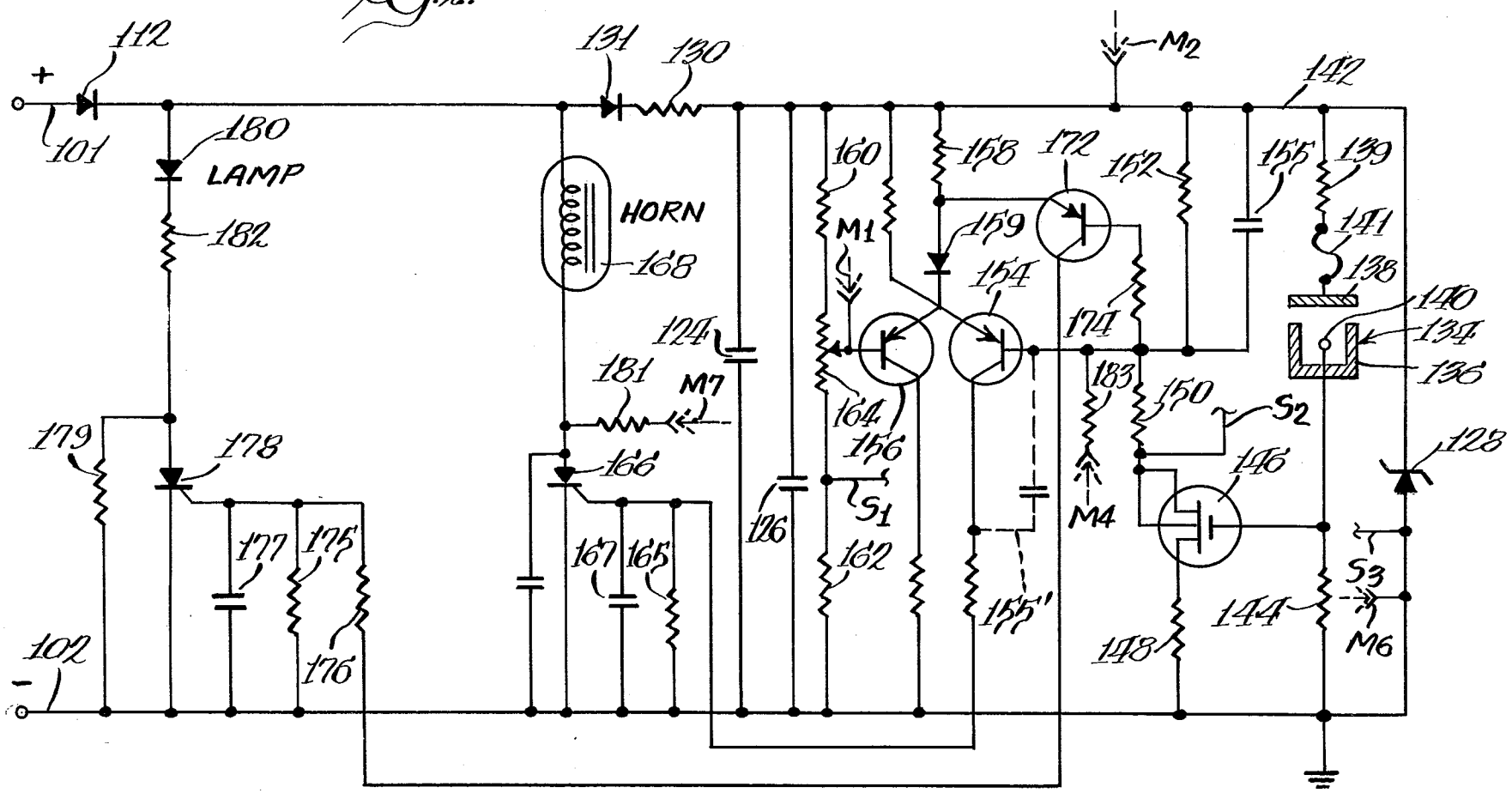
FIG. 2 is a detailed schematic diagram of a second embodiment of fire detector of the ionization type employing variable sensitivity and monitoring circuitry according to the invention.

Referring to the embodiment of FIG. 2, lead lines 101 and 102 are adapted to be connected to an AC power source, for example 120 volts, with the line 101 being connected to the hot side. The full wave AC of the source is rectified into half wave by the diode 112 having its anode connected to the line 101 which is used to power the alarm and indicating portions of the detector. The half wave 120 volt power is reduced in voltage, for example to 8.2 volts, for use in the sensing and monitoring portions of the detector by a zener diode 128 which is connected through a resistor 130 and diode 131 to the cathode of the diode 112. The anode of the zener diode 128 is connected to the common ground line 102. As an alternative a battery may be used to provide a self contained battery operated detector.

Two capacitors 124 and 126 are connected across the positive low voltage bus line 142 and the common ground 102 for filtering the rectified voltage from diode 131 and to remove voltage transients caused by transients in the source providing essentially DC current between the lines 102 and 142.

The fire detection circuitry of FIG. 2 is similar to that of FIG. 1 and comprises an ionization chamber 134 having a cup-shaped member 136, a target 138 and a radioactive source of ions 140. The target 138 of the ionization chamber 134 is connected through a resistor 139 in series with a thermostat 141 to the positive 8.2 volt bus line 142. The resistor 139 is provided to prevent electric shocks should the lines 101 and 102 be reserved by the installer. The thermostat 141 opens up at approximately 135° F to alarm the detector on heat alone. The cup-shaped member 136 is connected to the gate of a MOS-FET transistor 146. The drain of the transistor 146 is connected to ground potential through a resistor 148, and the source thereof is connected to the 8.2 volt bus 142 through resistors 150 and 152. The junction of the resistors 150 and 152 is connected to the base of the transistor 154, the transistor 154 together with transistor 156 and associated components forming a differential amplifier. The emitters of the transistors 154 and 156 are connected together and coupled to the bus line 142 through a resistor 158 and a diode 159. Alternatively, to suppress line transients the base of the transistor 154 may be capacitively coupled to the bus line 142 by capacitor 155 or, as shown in dashed lines, to its collector by capacitor 155'. The base of the transistor 156 is connected to the resistive divider network comprising resistors 160 and 162, and potentiometer 164. The collector of the transistor 154 is connected to the gate of a switch 166, such as a 200 volt rated SCR. The cathode of the SCR 166 is connected to the ground; the gate thereof is connected to ground by a resistor 165 and a capacitor 167 which prevents self triggering. The anode of SCR 166 is connected to a first transducer or alarm means, such as a 120 volt rated horn 168. The other terminal of the horn 168 is connected to the cathode of diode 112.

A transistor 172, which comprises the monitoring circuit, has an emitter connected to the junction of the resistor 158 and diode 159, and a base connected to the junction of resistors 152 and 150 through a resistor 174. The collector of the transistor 172 is connected through a resistor 176 to the gate of a second switch 178, which is also 200 volt rated SCR. The cathode of the SCR 178 is connected to ground potential; the gate thereof is connected to ground by a resistor 175 and a capacitor 177 which prevents self triggering. The anode of the SCR 178 is connected to a second transducer or indicator means, such as a light emitting diode 180, through a current limiting resistor 182. A resistor 179 is provided in parallel with the SCR 178 as protection for the SCR, the current normally flowing through this resistor with the SCR not triggered being insufficient to light the lamp 180.

Further, electric shielding is provided around the chamber 134 by conductors which are connected to the detector circuit for establishing certain potentials, for example: the lower left quadrant of the chamber 134 is shielded by a conductor S1 connected to the junction of potentiometer 164 and resistor 162; the lower right quadrant of the chamber is shielded by a conductor S2 connected to the junction of the source of the MOS-FET 146 and resistor 150; and the lower center of the chamber is shielded by a conductor S3 connected to the line 102.

In addition for ease of testing and servicing, metering points are provided in the circuit. The metering points terminate at one end in a seven pin base type connector which is adapted to receive a test instrument, and at the other end are connected as follows: M1—base of transistor 156, M2—low voltage bus line 142, M3—not used (not shown), M4—base of transistor 154, M5—not used (not shown), M6—ground line 102, M7—junction of switch 166 and alarm 168. Further, since the point M7 is at 120 volts, a resistor 181 is provided in the metering connection thereof to reduce the possibility of shock. A similar resistor 183 is provided for M4.

Operation of the embodiment of FIG. 2 is similar to that of FIG. 1 and will only be briefly described. When no products of combustion are present in the ambient air, the potentiometer 164 is adjusted to render transistor 156 conductive with the transistor 154 nonconductive. In the event of a fire, the products of combustion increase the impedance of the ionization chamber 134, lower the voltage applied to the gate of the transistor 146 and cause the conductivity of the transistor 146 to increase, lowering the voltage at the junction of the resistors 150 and 152. When the voltage at junction of the resistors 150 and 152 and the base of the transistor 154 drops below the reference voltage present at the base of the transistor 156, the transistor 156 is rendered nonconductive and the tansistor 154 is rendered conductive. Rendering transistor 154 conductive causes the SCR 166 to become conductive so as to energize the horn 168. The sensitivity of the detector to changes in the impedance of the ionization chamber 134 may be altered by adjusting the potentiometer 164.

With the potentiometer 164 correctly set, the voltage across the base to emitter junction of the transistor 154 alone is insufficient to forward bias a base to emitter junction and to render a transistor conductive. The current flowing through the diode 159 as a result of the conductivity of the transistor 156 causes approximately 0.6 volts to be present across the diode 159. The 0.6 volts present across the diode 159 plus the 0.3 volts across the base to emitter junction of transistor 154 results in a total of 0.9 volts between the anode of the diode 159 and the base of the transistor 154, which is sufficient to turn on the transistor 172. When the transistor 172 is rendered conductive, current is supplied thereby to the gate of the second switch 178 to turn on the second transducer or light source 180 to indicate that the circuit is operating properly.

Should the voltage at the line 142 fail for any reason, the transistor 172 would be rendered nonconductive, thereby rendering switch 178 nonconductive and extinguishing the light source 180. In similar fashion, should the transistor 146 fail in its most common mode — open circuit — the voltage at the junction of resistors 150 and 152 would increase, thereby rendering transistor 172 nonconductive and extinquishing the light source 180.

Should the potentiometer 164 be improperly adjusted to provide too high a voltage to the base of the transistor 156, the transistor 156 would be rendered nonconductive and the transistor 154 would be rendered conductive to sound the horn 168. If the potentiometer 164 is improperly adjusted with the voltage at the base of the transistor 156 being too low, the horn would not sound, but the voltage between the anode of the diode 159 and the base of the transistor 154 would be less than 0.9 volts, and the transistor 172 would be rendered nonconductive, thereby extinguishing the light source 180 to indicate improper setting of the potentiometer 164. Hence, like the monitoring circuit of FIG. 1, the monitoring circuit of FIG. 2 provides the added feature of preventing incorrect setting of the sensitivity adjustment of the unit which could otherwise result in degraded sensitivity of the unit.

It should be understood that the resistor shown between the collector of transistor 156 and the line 102 could be removed and replaced by a length of conductor, likewise the resistors 150 and 148 could be similarly replaced.

It should be further understood that the fire detector of the present invention can be simplified by omitting the supervision portion. For example, in the embodiment of FIG. 1, the diode 59, resistor 58, transistor 72, resistors 74 and 76, transistor 78 and its bias resistor (not numbered) may be omitted, and the resistor 82 can be connected to ground. Similarly for the embodiment of FIG. 2, the diode 159, resistor 158, transistor 172, resistors 174, 175, 176 and 179, capacitor 177 and SCR 178 may be omitted, and the resistor 182 may be connected to ground.

Having thus described what is regarded to be the preferred forms of the invention, it should be appreciated that various changes, rearrangements and modifications may be made therein without departing from the scope and spirit of the invention, as defined by the appended claims.

What is claimed is:

1. In a detecting device including:

a power source;

sensor means for providing a sensor signal representative of a predetermined sensed condition, said sensor means being connected in circuit with said power source;

alarm means for providing an alarm when the predetermined condition is sensed, said alarm being connected in circuit with said power source;

the improvement comprising;

adjustable means for providing an adjustable reference signal for varying the sensitivity of said device, said adjustable means being connected in circuit with said power source;

indicator means for indicating the condition of said power source, said indicator means being connected in circuit with said power source;

first comparison means for comparing the amplitudes of the reference signal and the sensor signal, said first comparison means being connected to said power source, said sensor means, said adjustable means and said alarm means, said first comparision means providing a first signal for operating said alarm means when the sensor signal has a first predetermined relationship to the reference signal, said first comparison means providing a second signal when said sensor signal has a second predetermined relationship to the reference signal;

signal offsetting means connected to said first comparison means for increasing the amplitude of said second signal to a third signal; and second comparison means for comparing the amplitudes of the third signal and the sensor signal, said second comparison means being connected to said signal offsetting means, the interconnection of said first comparison means and said sensing means, and said indicator means, said second comparison means operating said indicator means to indicate improper adjustment of said adjustable means, said first comparison means being incapable of operating said alarm means when the third signal has a predetermined relationship to the sensor signal;

whereby said indicator means indicates improper operation of said device should said power source fail, or should said adjustable means be improperly set.

2. In a detecting device as in claim 1, wherein said indicator means is energizable by said power source to indicate proper and de-energizable to indicate improper operation thereof, and said second comparison means de-energizes said indicator means to indicate proper adjustment of said adjustable means.

3. In a detecting device as in claim 1, wherein said first comparison means includes a common impedance, a pair of transistors each having base, emitter and collector electrodes, said emitter electrodes being coupled together and to said common impedance, the base of one transistor being coupled to said adjustable means, the base of the second transistor being coupled to said sensor means, the collector of said second transistor being coupled to said alarm means, said second comparision means includes a third transistor coupled to said common impedance and said sensor means, and said signal offsetting means comprises a diode connected between said second and third transistors.

4. In a detecting device as in claim 1, wherein said first comparison means includes a differential amplifier having first and second inputs, said first input being connected to said adjustable means and said second input being connected to said sensor means, said adjustable means including a potentiometer.

5. In a detecting device as in claim 1, wherein said signal offsetting means is a diode.

6. In a detecting device as in claim 1, wherein said alarm means includes a first switch device and an alarm device in series, and wherein said indicator means includes a second switch device and an indicator device in series, said first switch device being operated by said first comparison means and said second switch device being operated by said second comparison means.

7. In a detecting device as in claim 6, wherein said first and second switch devices are SCRs, said first comparison means comprises a pair of transistors having their emitters connected together and the collector of one of said transistors connected to the gate of the SCR comprising said first switch device, and said second comparison means comprises a third transistor having its emitter connected to said signal offsetting means, its base connected to the base of said one transistor and its collector connected to the gate of the SCR comprising said second switch device.

8. In a detecting device as in claim 6, wherein said first and second switch devices are transistors, said first comparison means comprises a pair of transistors having their emitters connected together and the collector of one of said pair of transistors connected to the base of the transistor comprising said first switch device, and said second comparison means comprises another transistor having its emitter connected to the signal offsetting means, its base connected to the base of said one transistor and its collector connected to the base of the transistor comprising said second switch device.

9. A detecting device comprising:

a source of power;

sensor means for providing a signal voltage representative of a predetermined sensed condition and being connected to said power source;

a source of reference potential connected in circuit with said power source;

first voltage comparison means connected to said power source, said sensor means and said source of reference potential, said first voltage comparison means being responsive to a first predetermined difference in the amplitudes of said reference potential and said signal voltage;

alarm means connected to said first voltage comparison means and responsive thereto for providing an alarm in response to said first predetermined difference in the amplitudes of said reference potential and said signal voltage;

second voltage comparison means coupled to said source of reference potential and said sensing means, said second voltage comparison means being responsive to a second predetermined difference in the amplitudes of said reference potential and said signal voltage; and indicator means connected to said power source and said second voltage comparison means, said indicator means being responsive to said second voltage comparison means for providing an indication in response to said second predetermined difference in the amplitudes of said reference potential and said signal voltage;

said first voltage comparison means including a common impedance, a pair of transistors each having base, emitter and collector electrodes, said emitter electrodes being coupled together and to said common impedance, the base of one of said transistors being coupled to said source of reference potential, the base of the other of said transistors being coupled to said sensor means, and one of said collectors being coupled to said alarm means;

said second comparison means including transistor means having first, second and third electrodes and voltage offsetting means including a diode connected in circuit with said emitters and said common impedance, said first electrode being coupled to said diode, said second electrode being coupled to the interconnection of said first voltage comparison means and said sensor means, said third electrode being coupled to said indicator means.

10. A detecting device comprising:

a power source;

sensor means for providing a sensor signal representative of a predetermined sensed condition, said sensor means being connected in circuit with said power source;

alarm means for providing an alarm when the predetermined condition is sensed, said alarm being connected in circuit with said power source;

adjustable means for providing an adjustable reference signal for varying the sensitivity of said device, said adjustable means being connected in circuit with said power source;

indicator means for indicating the condition of said power source and of said sensor means, said indicator means being connected in circuit with said power source;

first comparison means for comparing the reference signal and the sensor signal, said first comparison means being connected to said power source, said sensor means, said adjustable means and said alarm means, said first comparison means providing a first signal for operating said alarm means when the sensor signal has a predetermined relationship to the reference signal, said first comparison means providing a second signal when said sensor signal has a second predetermined relationship to the reference signal, and second comparison means for comparing the second signal from said first comparison means to the sensor signal, said second comparison means being connected to said first comparison means, said sensing means and said indicator means, said second comparison means operating said indicator means to indicate improper adjustment of said adjustable means, said first comparison means being incapable of operating said alarm means when the second signal from said first comparison means has a predetermined relationship to the sensor signal;

whereby said indicator means indicated improper operation of said device should said power source or sensor means fail, or should said adjustable means be improperly set.

11. A detecting device as in claim 10, wherein said indicator means in energizable by said power source to indicated proper and de-energizable to indicate improper operation thereof, and said second comparison means de-energizes said indicator means to indicate improper adjustment of said adjustable means and includes signal offsetting connected to said first comparison means.

12. A detecting device as recited in claim 10, wherein said first comparison means includes a common impedance, a pair of transistors each having base, emitter and collector electodes, said emitter electrodes being coupled together and to said common impedance, the base of one transistor being coupled to said adjustable means, the base of the second transistor being coupled to said sensor means, the collector of said second transistor being coupled to said alarm means; said second comparison means includes a third transistor connected to the junction of said emitters and said common impedance and to said sensor means, and signal offsetting means being connected between said junction and said second transistor.

13. A detecting device as recited in claim 12, wherein said signal offsetting means is a diode.

14. A detecting device as in claim 10, wherein said sensor means includes an ionization device whose impedance changes upon the presence of products of combustion, and an amplifying device connected to said ionization device and said first and second comparison means.

15. A detecting device as in claim 14, wherein said amplifying device is a MOS-FET having a gate, drain and source, said gate being connected to said ionization device, said source being connected to said first and second comparison means and said drain being connected to said power source.

16. A fire detector adapted to be connected to a pair of AC power lines comprising a transformer for reducing the voltage of said AC power lines, said transformer having a pair of low voltage output lines, rectifying means connected to said low voltage lines for rectifying low voltage AC power to DC power, said rectifying means having a pair of DC output voltage power lines, filtering means connected between said pair of DC voltage lines, voltage regulating means connected to said pair of DC voltage lines, an ionization device having a target and chamber, first impedance means connected in series with said ionization device, the circuit of said ionization device and said first impedance means being in parallel with said voltage regulating means, sensor means, second and third impedance means connected in series with said sensor means, the circuit of said second and third impedance means and said sensor means being in parallel with said voltage regulating means and connected to said ionization device, fourth impedance means connected to one of said DC lines, first transistor means, second transistor means, said first and second impedance means having common emitters connected to said forth impedance means, the collector of one of said transistor means being connected to the other of said DC lines, the base of said other transistor means being connected to the junction of said sensor means and said second impedance means, fifth impedance means connected between said DC lines, the base of said one transistor means being adjustably connected to said fifth impedance means for providing variable sensitivity of the detector to products of combustion, alarm means, first switch means in series with said alarm means, said alarm means and first switch means being connected to said DC lines, the collector of the other of said transistor means being connected to said first switch means, third transistor means, the emitter of said third transistor means being connected to said fourth impedance means, the base of said third transistor means being connected to the base of said other transistor means, indicator means, second switch means in series with said indicator means, said indicator means and said second switch means being connected to said DC lines, the collector of said third transistor means being connected to said second switch means, whereby should products of combustion be present an alarm is given by said alarm means and should the sensitivity of the detector be too high as established by the adjustment of the connection of the base of said one transistor means to said fifth impedance means an alarm is given by said alarm means or should the sensitivity of the detector be too low as established by said adjustment or should said sensor means or power lines fail an indication is given by said indicator means and said alarm is not given.

17. A fire detector as in claim 16, wherein said sensor means is a MOS-FET having its gate connected to said ionization device and a source connected to said other and third transistor means, said first and second switch means comprise darlington amplifier pairs, and said fourth impedance means comprises a resistor in series with a diode, said emitter of said third transistor means being connected to the junction of said resistor and diode.

18. A fire detector adapted to be connected to a pair of AC power lines comprising rectifying means connected to said AC power lines for rectifying the AC power to DC power, said rectifying means having a pair of DC output voltage power lines, voltage regulating means connected to said pair of DC voltage lines, an ionization device having a target and chamber, first impedance means connected in series with said ionization device, the circuit of said ionization device and said first impedance means being in parallel with said voltage regulating means, sensor means, second and third impedance means connected in series with said sensor means, the circuit of said second and third impedance means and said sensor means being in parallel with said voltage regulating means and connected to said ionization device, fourth impedance means connected to one of said DC lines, first transistor means, second transistor means, said first and second transistor means having common emitters connected to said forth impedance means, the collector of one of said transistor means being connected to the other of said DC lines, the base of said other transistor means being connected to the junction of said sensor means and said second impedance means, fifth impedance means connected between said DC lines, the base of said one transistor means being adjustably connected to said fifth impedance means for providing variable sensitivity of the detector to products of combustion, alarm means, first switch means in series with said alarm means, said alarm means and first switch means being connected to said AC lines, the collector of the other of said transistor means being connected to said first switch means, third transistor means, the emitter of said third transistor means being connected to said fourth impedance means, the base of said third transistor means being connected to the base of said other transistor means, indicator means, second switch means in series with said indicator means, said indicator means and said second switch means being connected to said AC lines, the collector of said third transistor means being connected to said second switch means, whereby should products of combustion be present in an alarm is given by said alarm means and should the sensitivity of the detector be too high as established by the adjustment of the connection of the base of said one transistor means to said fifth impedance means an alarm is given by said alarm means or should the sensitivity of the detector be too low as established by said adjustment or should said sensor means or power lines fail an indication is given by said indicator means and said alarm is not given.

19. A fire detector as in claim 18, wherein said sensor means is a MOS-FET having its gate connected to said ionization device and a source connected to said other and third transistor means, said first and second switch means comprise SCRs, and said fourth impedance means comprises a resistor in series with a diode, said emitter of said third transistor means being connected to the junction of said resistor and diode.

20. A fire detector adapted to be connected to a pair of AC power lines, comprising a transformer for reducing the voltage of said AC power lines, said transformer having a pair of low voltage output lines, rectifying means connected to said low voltage lines for rectifying the low voltage AC power to DC power, said rectifying means having a pair of DC output voltage lines, filtering means connected between said pair of DC voltage lines, voltage regulating means connected to said pair of DC voltage lines, an ionization device having a target and chamber, first impedance means connected in series with said ionization device, the circuit of said ionization device and said first impedance means being in parallel with said voltage regulating means, sensor means, second and third impedance means connected in series with said sensor means, the circuit of said second and third impedance means and said sensor means being in parallel with said voltage regulating means and connected to said ionization device, fourth impedance means connected to one of said DC lines, first transistor means, second transistor means, said first second transistor means having common emitters connected to said fourth impedance means, the collector of one of said transistor means being connected to the other of said DC lines, the base of said other transistor means being connected to the junction of said sensor means and said second impedance means, fifth impedance means connected between said DC lines, the base of said one transistor means being adjustably connected to said first impedance means for providing variable sensitivity of the detector to products of combustion, alarm means, switch means in series with said alarm means, said alarm means and switch means being connected to said DC lines, the collector of the other of said transistor means being connected to said switch means, indicator means connected to said DC lines, whereby should products of combustion be present an alarm is given by said alarm means and should the sensitivity of the detector be too high as established by the adjustment of the connection of the base of said one transistor means to said fifth impedance means an alarm is given by said alarm means or should said power lines fail an indication is given by said indicator means and said alarm is not given.

21. A fire detector adapted to be connected to a pair of AC power lines comprising rectifying means connected to said AC power lines for rectifying the AC power to DC power, said rectifying means having a pair of DC output voltage lines, filtering means connected between said pair of DC voltage lines, voltage regulating means connected to said pair of DC voltage lines, an ionization device having a target and chamber, first impedance means connected in series with said ionization device, the circuit of said ionization device and said first impedance means being in parallel with said voltage regulating means, sensor means, second and third impedance means connected in series with said sensor means, the circuit of said second and third impedance means and said sensor means being in parallel with said voltage regulating means and connected to said ionization device, fourth impedance means connected to one of said DC lines, first transistor means, second transistor means, said first and second transistor means having common emitters connected to said fourth impedance means, the collector of one of said transistor means being connected to the other of said DC lines, the base of said other transistor means being connected to the junction of said sensor means and said second impedance means, fifth impedance means connected between said DC lines, the base of said one transistor means being adjustably connected to said fifth impedance means for providing variable sensitivity of the detector to products of combustion, alarm means, switch means in series with said alarm means, said alarm means and switch means being connected to said AC lines, the collector of the other of said transistor means being connected to said switch means, indicator means connected to said AC lines, whereby should products of combustion be present an alarm is given by said alarm means and should the sensitivity of the detector be too high as established by the adjustment of the connection of the base of said one transistor means to said fifth impedance means an alarm is given by said alarm means or should said power lines fail an indication is given by said indicator means and said alarm is not given.

22. A fire detector adapted to be connected to a power source comprising voltage regulating means connected to said power source, an ionization device having a target and chamber, first impedance means connected in series with said ionization device, the circuit of said ionization device and said first impedance means being in parallel with said voltage regulating means, sensor means, second and third impedance means connected in series with said sensor means, the circuit of said second and third impedance means and said sensor means being in parallel with said voltage regulating means and connected to said ionization device, fourth impedance means connected to one side of said power source, first transistor means, second transistor means, said first and second transistor means having common emitters connected to said fourth impedance means, the collector of one of said transistor means being connected to the other side of said power source, the base of said other transistor means being connected to the junction of said sensor means and said second impedance means, fifth impedance means connected to said power source, the base of said one transistor means being adjustably connected to said fifth impedance means for providing variable sensitivity of the detector to products of combustion, alarm means, switch means in series with said alarm means, said alarm means and switch means being connected to said power source, the collector of the other of said transistor means being connected to said switch means, indicator means connected to said power source, whereby should products of combustion be present in an alarm is given by said alarm means and should the sensitivity of the detector be too high as established by the adjustment of the connection of the base of said one transistor means to said fifth impedance means an alarm is given by said alarm means or should said power lines fail an indication is given by said indicator means and said alarm is not given.

23. A detecting device as in claim 16, further comprising electric shield means around said chamber, said shield means being connected to said fifth impedance means for establishing a potential around said chamber.

24. A detecting device as in claim 22, further comprising at least one electric shield means around said chamber, said one shield means being connected to a portion of said device having a potential substantially that of said fifth impedance means.

* * * * *